US006089288A

United States Patent [19]

Crowe

[11] Patent Number: 6,089,288

[45] Date of Patent: Jul. 18, 2000

[54] METHOD AND APPARATUS FOR BENDING A LAMINATE-COVERED SHEET OF WOOD TO PROVIDE A ROUNDED CORNER

[75] Inventor: Scott D. Crowe, Roseburg, Oreg.

[73] Assignee: FCC Commercial Furniture, Roseburg, Oreg.

[21] Appl. No.: 09/302,015

[22] Filed: Apr. 29, 1999

[51] Int. Cl.[7] ..... B27F 1/00; B27H 1/00

[52] U.S. Cl. ..... 144/355; 144/270; 144/349; 144/380; 144/2.1; 144/381

[58] Field of Search ..... 144/2.1, 270, 329, 144/344, 345, 349, 350, 380, 355, 356, 381; 297/271.6, 396; 52/631; 156/196, 267; 403/190, 406.1, 407.1, 408.1

[56] References Cited

U.S. PATENT DOCUMENTS

| | | | |
|---|---|---|---|
| 230,437 | 7/1880 | Pine . | |
| 693,323 | 2/1902 | Rodgers | 297/271.6 |
| 709,204 | 9/1902 | Clark . | |
| 1,346,161 | 7/1920 | Basquin | 144/380 |
| 2,002,228 | 5/1935 | Meyercord et al. | 144/349 |
| 2,081,638 | 5/1937 | Owens . | |
| 4,210,182 | 7/1980 | Danko | 144/349 |
| 4,236,558 | 12/1980 | Sabo | 144/355 |

*Primary Examiner*—W. Donald Bray
*Attorney, Agent, or Firm*—Chernoff, Vilhauer, McClung & Stenzel

[57] ABSTRACT

A method for bending a sheet of wood with a plastic laminate applied to its outside face to form a rounded corner on the sheet includes first making a cut across the sheet which is configured to completely wrap around a dowel when the sheet is bent to the desired angle. The laminate is heated prior to bending if heating is required to make it bendable. Adhesive is applied to the dowel, and the dowel is placed on the cutout. The sheet is then bent around the dowel and is held in place until the adhesive has cured and the laminate cooled down. An apparatus attaches to both portions of the sheet and causes it to be bent around the dowel without causing the laminate to stretch or contract.

20 Claims, 7 Drawing Sheets

METHOD AND APPARATUS FOR BENDING A LAMINATE-COVERED SHEET OF WOOD TO PROVIDE A ROUNDED CORNER

FIELD OF THE INVENTION

The present invention relates to forming rounded corners in laminate-covered sheets of wood.

BACKGROUND AND SUMMARY OF THE INVENTION

In the manufacture of many useful articles, such as furniture, it is often desirable to provide for angled corners. Such corners are typically right angles, as at the intersection of the sides and front or back of a cabinet, but maybe obtuse or acute angles. Also, furniture pieces often have protrusions, such as in the front surface of the countertops. Generally, such angles are formed by abutting and joining two panels of a base material, by dovetailing the panels, by miter and doweling, or by external bracing. Generally, protrusions have a front edge which is at a right angle to the top and bottom surfaces. The formation of angles by joining results in sharp corners which may be undesirable. As a result, in certain applications, such as furniture used in the food industry, round corners are preferred. Rounded corners are easier to clean than are angled corners, and pose less of a danger to children and other individuals who might bump into the corner.

Techniques for obtaining rounded corners in wood articles are known in the prior art. Rounded corners are obtained by bending a sheet of material to obtain the desired angular bend. Various techniques for bending wood and making articles from bent wood have been disclosed in Pine, U.S. Pat. No. 230,457; Rogers, U.S. Pat. No. 693,323, Clark, U.S. Pat. No. 709,204; Basquin, U.S. Pat. No. 1,346,161; and Sabo, U.S. Pat. No. 4,236,558.

Pine discloses a technique for bending wood in which a rectangular or semi-circular cutout is made partially through a length of wood, leaving a thin connecting strip. The wood is then bent around a template placed inside the cutout to produce a bend in the wood at the cut. In the method of Pine, a right-angled corner results which is a point of structural weakness. The corner is either formed by the template which produces a multi-angled interior, when a rectangular cutout is used, or by the tangent of the circular opening.

Rogers discloses a chair made from a single piece of wood that is bent to provide the various parts of the chair, including the seat, back and arms. Bends in the wood are formed by cutting away the major portion of the wood stock to form a thin, bendable web. Arm and leg elements form an elliptical solid portion within the bend at the front of the seat.

Clark discloses a method for bending wood that is similar to that of Pine. Clark differs from Pine in that the cut in the length of wood and the template are rounded at their internal and external extremities, respectively, to eliminate a point of structural weakness in the bend, and the inner portion of the template is cut to provide a single right angle at the interior of the bend.

Basquin discloses a method for bending plywood in which the innermost ply is removed at the desired portion so that the remaining next innermost ply has its grain extending lengthwise perpendicular to the direction of the bend. The result is a bend with decreased thickness of wood compared to the wood on either side of the bend. This provides a point of structural weakness in the bend.

Sabo discloses a method for making a 90 degree corner with a rounded socket. A rounded oblong cut is made in the length of wood. The wood is cut at a 45 degree angle obliquely to the lateral inner surface of the circular portions to result in a closed circular socket when the wood is bent. The wood is steamed to provide flexibility for bending. The socket provides an opening for introducing an elongate circular element, such as a chair leg. The corner is locked in place by using a dowel that is inserted in matching holes between the circular opening and the inner surfaces of the angle.

Bending wood sheets that are covered with plastic laminate is much more difficult. In order to bend a laminate, it must first be heated to make it bendable. However, when the laminate is heated it becomes soft and must be supported during the bending process. Furthermore, when a wood sheet with plastic laminate is bent, the laminate tends to be stretched, since it is at the outside of the bend.

Owens, U.S. Pat. No. 2,081,638 discloses a method of bending solid or laminated boards in which a rectangle with rounded ends is cut into the board to leave a bendable web having the thickness of the veneer or of the veneer and a thin portion of the underlying wood. A layer of veneer is glued to the inside of the cut and a heated circular die is positioned on this layer of veneer. The board is then bent at the web around the die to result in a bend with a veneer coating on its inner side. Owens does not address the problem of stretching that occurs during bending.

A first preferred embodiment of the subject invention provides a method for bending a sheet of wood having a plastic laminate on its outside face to form a rounded corner. A cut which opens out of the inside face of the sheet is made across the sheet at the line of the corner. This cut forms a gap in the inside face of the sheet. The cut has a cross-sectional shape that will cause it to close into an elongate, circular, cylindrical opening having a predetermined diameter with the gap being substantially closed, when the sheet is bent to its desired angle. The plastic laminate is then heated to make it bendable. A circular cylindrical dowel with the same predetermined diameter having adhesive applied to it is placed in the cut in the sheet. The sheet is then bent around the dowel until the sheet completely surrounds the dowel and the sheet is held in place until the laminate cools and the adhesive cures.

A second preferred embodiment of the invention provides an apparatus for bending a sheet of laminate-covered wood according to this method. A first platform engages the outside face of the sheet of material on one side of the cut. A second platform engages the outside face of the sheet on the other side of the cut. A mechanism rotates the first platform while simultaneously translating it toward the cut in a manner in which the laminate is not stretched while the sheet is being bent.

In one preferred embodiment, this mechanism includes a rack, which is attached to and movable with, the second platform, and a pinion which engages the rack and is not movable with the second platform. The pinion is located so that its center line is coaxial with the center line of the dowel when the sheet is bent around it.

The apparatus also provides a heater for heating the laminate before bending, and a spindle for rotatably carrying the dowel and placing it in the cut. The apparatus also includes an adhesive gun for applying adhesive to the dowel before it is placed on the cut. The apparatus also includes a dowel heater for preheating the dowel before the adhesive is applied.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Referring to FIGS. 1A through 4D, sheets of wood 100, which are to be bent, have a sheet of laminate 120 on their outside surfaces. The laminate typically is a thermoplastic material such a FORMICA, but it can be a wide range of materials. Some of these materials will have to be heated to be bent and others will not. If desired, a sheet of laminate 121 can be placed over the inside surface as well. A cutout 117 is made across the sheet at the line the sheet is to be bent around. The shape of the cutout depends on the angle of the bend. The cutout opens out of the inside face of the sheet and a gap is formed in the inside face. The cutout always is formed from a series of circular cylindrical cuts. Rectangular precuts can be made in the sheet first to expedite the process. The cutout is made using standard woodworking techniques.

Figure 1A:
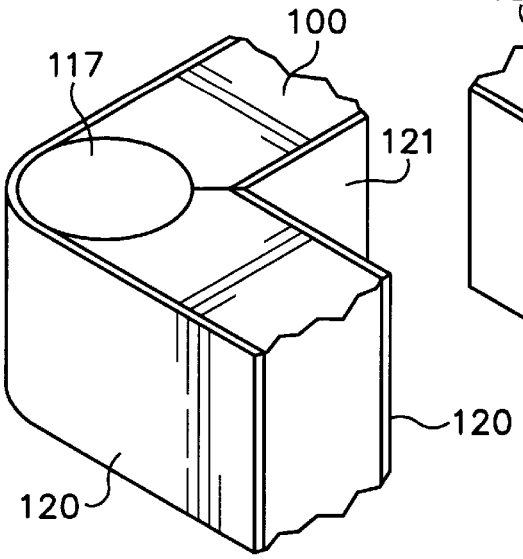
FIGS. 1A and 1B are perspective views of a portion of a laminated sheet of wood having a cutout therein before and after bending 90 degrees to form a right angle, according to the method of the subject invention.
Figure 1B:
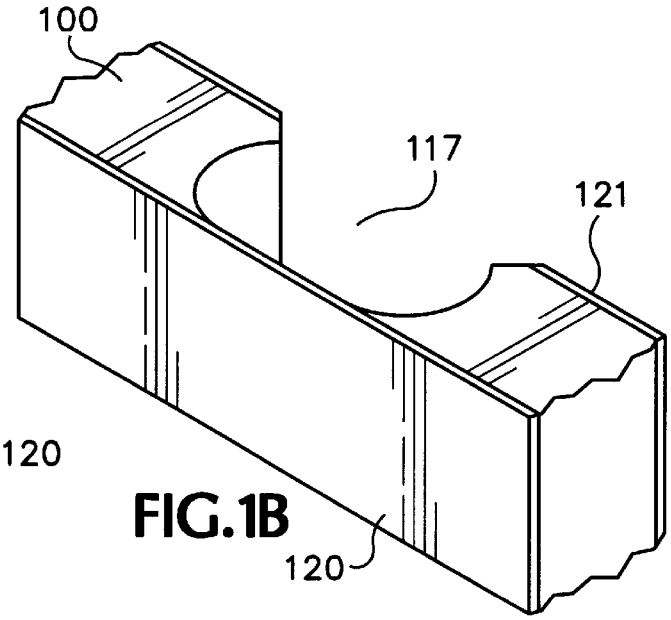
Figure 2A:
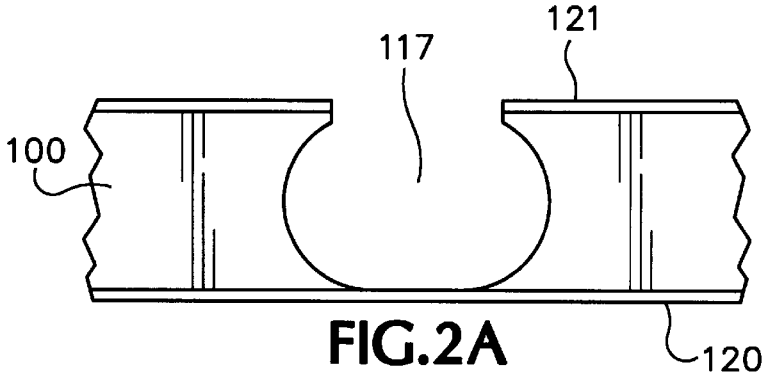
FIGS. 2A and 2B are perspective views of a portion of a laminated sheet of wood having a cutout therein before and after bending at 45 degrees to form an obtuse angle, according to the method of the subject invention.
Figure 2B:
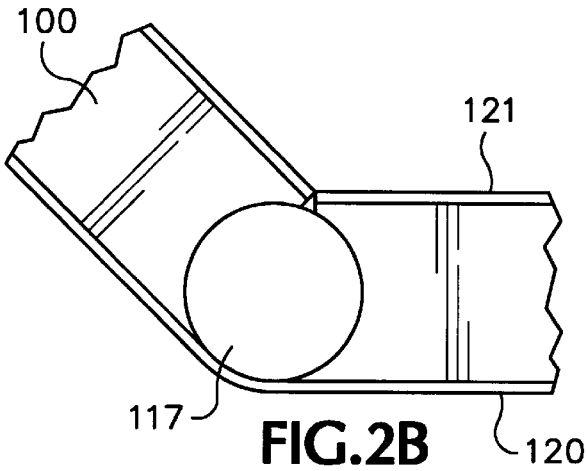
Figure 3A:
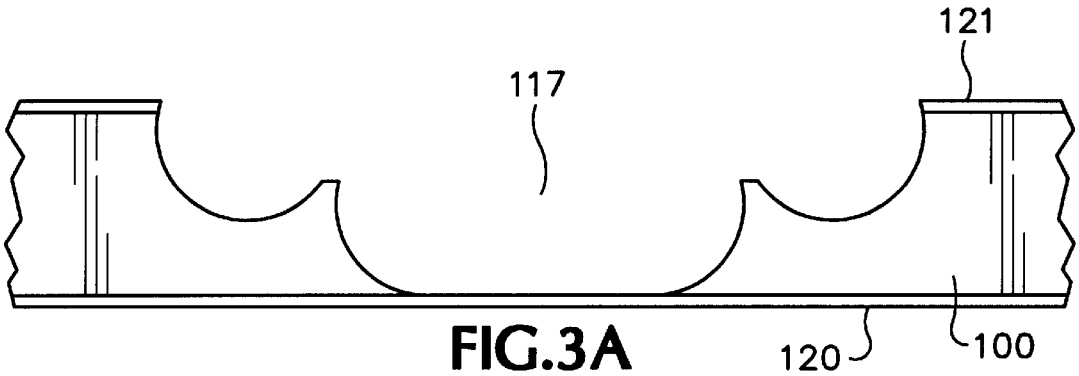
FIGS. 3A and 3B are perspective views of a portion of a laminated sheet of wood having a cutout therein before and after bending at 135 degrees to form an acute angle, according to the method of the subject invention.
Figure 3B:
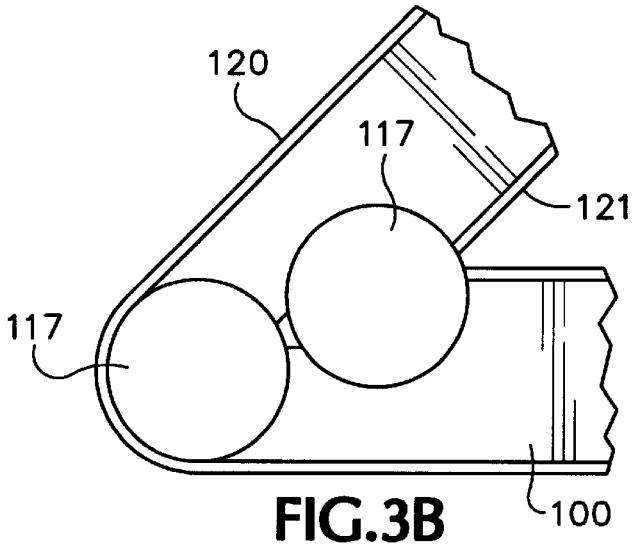
Figure 4A:
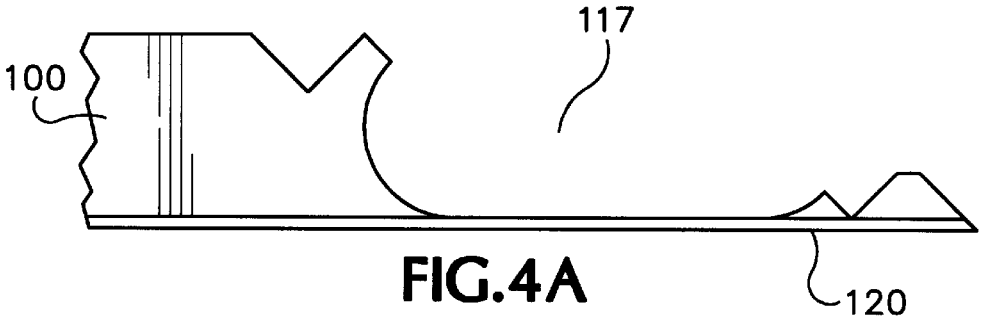
FIGS. 4A and 4B are perspective views of a portion of a laminated sheet of wood having a cutout therein before and after bending at 180 degrees to form a bullnose end projection, according to the method of the subject invention.
Figure 4B:
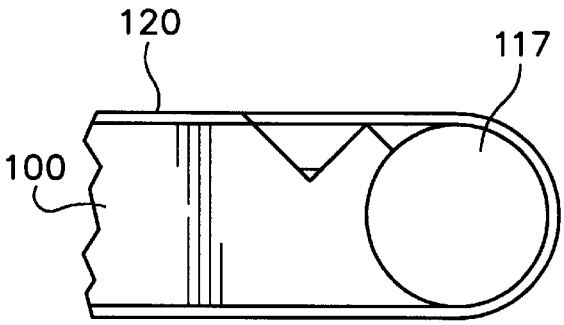
Figure 5:
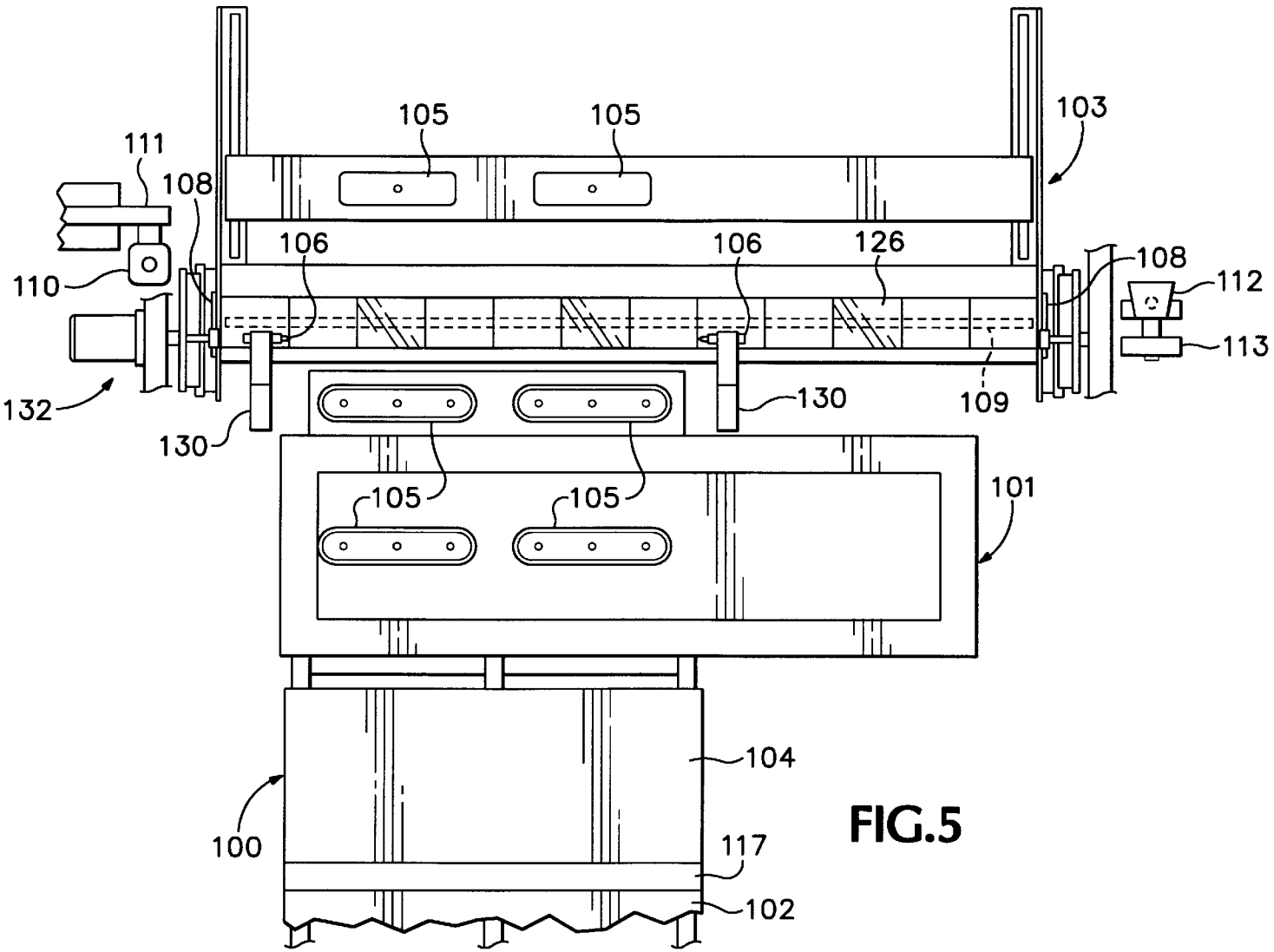
FIG. 5 is a plan view of the apparatus of the subject invention before the sheet is placed on it.
Figure 6:
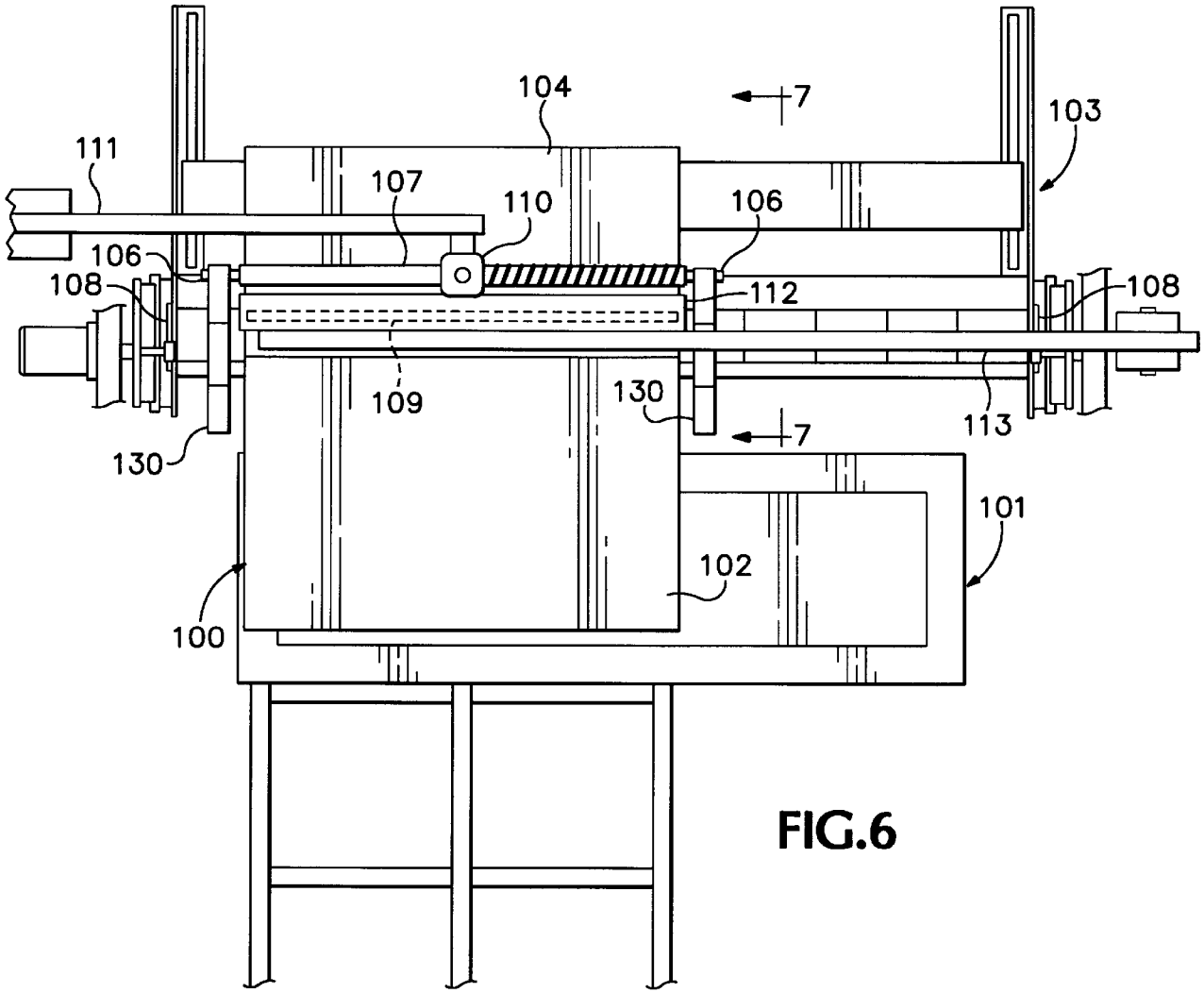
FIG. 6 is a plan view of the apparatus with the sheet in place.
Figure 7:
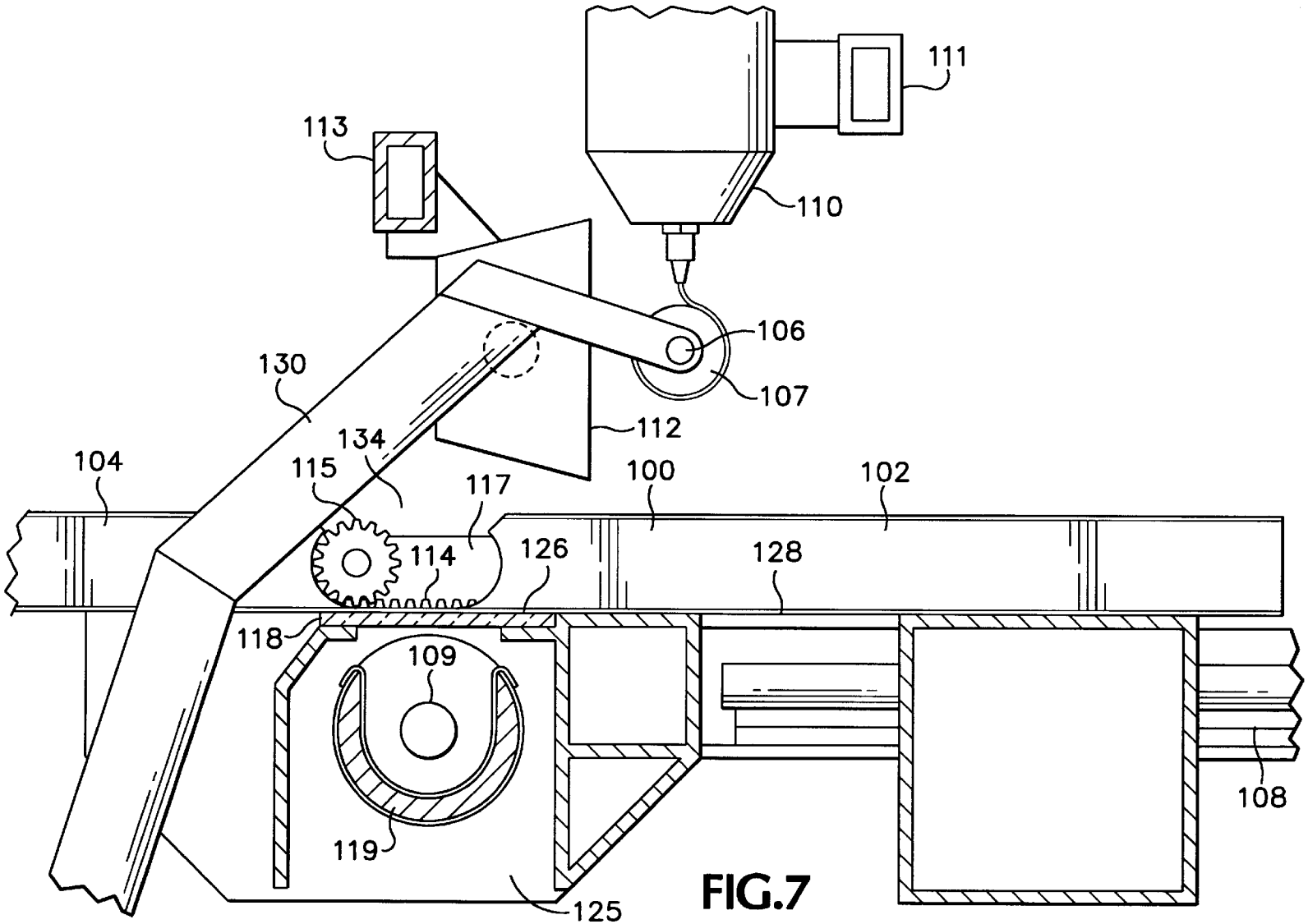
FIG. 7 is a partial side elevational view of the apparatus, at an enlarged scale, before bending.
Figure 8:
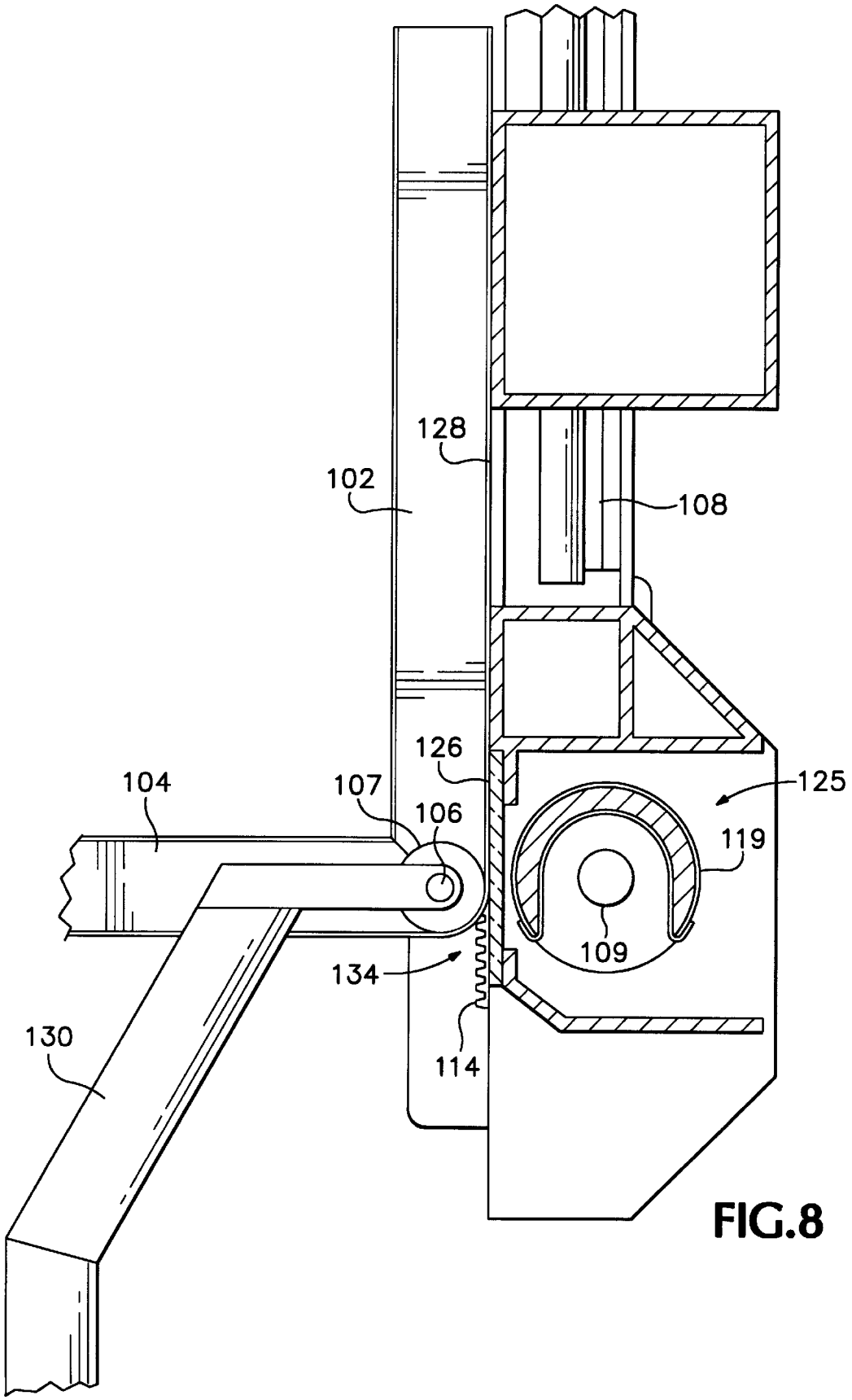
FIG. 8 is a partial side elevational view of the apparatus, at an enlarged scale, after bending.
Figure 9:
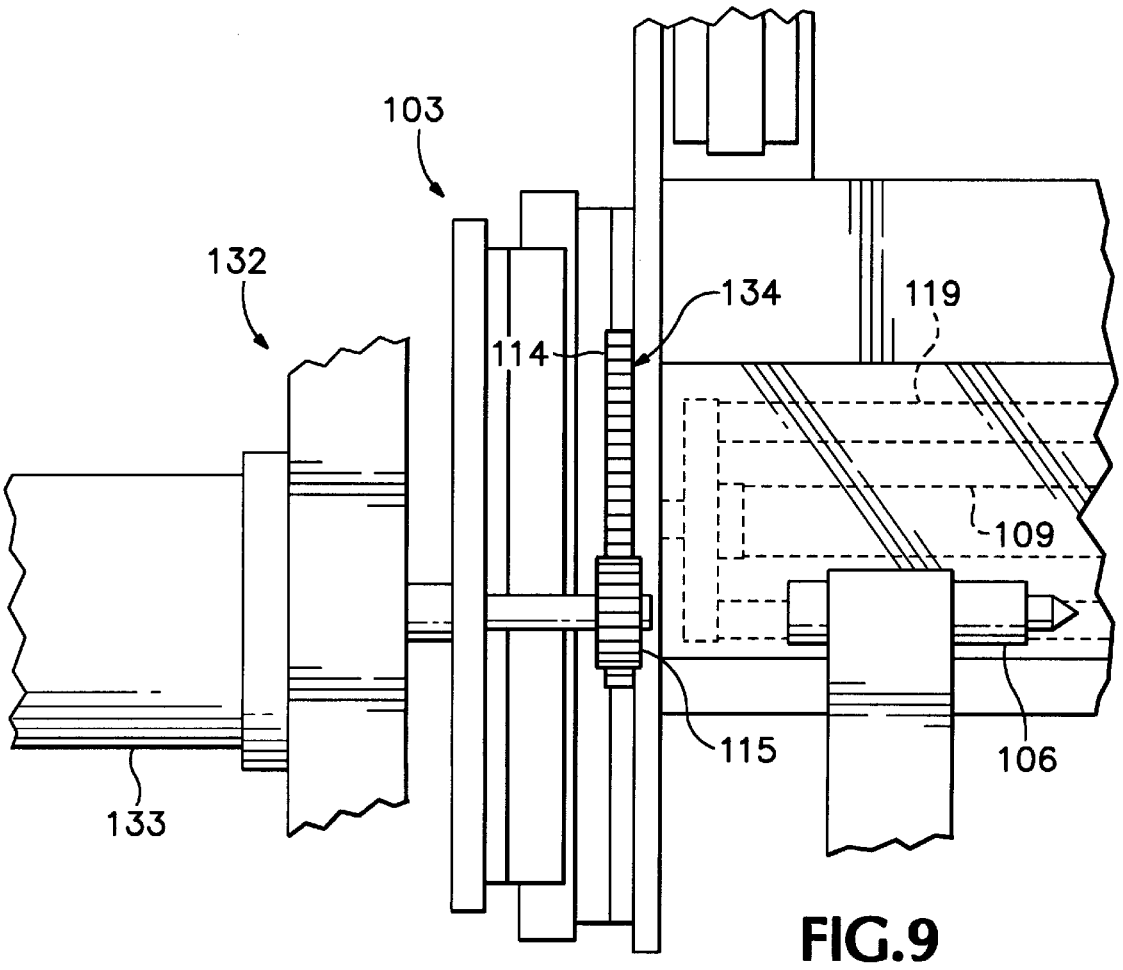
FIG. 9 is a detail plan view of the regulating mechanism of the apparatus.
Figure 10:
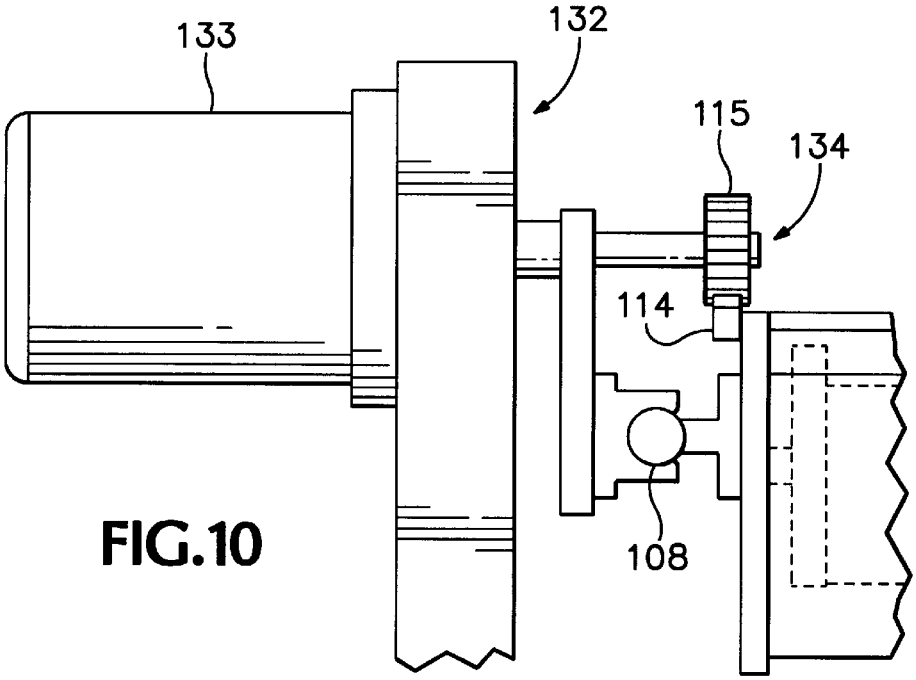
FIG. 10 is a detail elevation view of the regulating mechanism of the apparatus.

The shape of the cutout is such that when the sheet is bent to the desired angle, the cutout will have a circular cylindrical cross-sectional shape with a predetermined diameter and the gap will be substantially closed. The length of the exposed laminate in the cutout is equal to the portion of the circumference of a circle having the predetermined diameter that would be circumscribed by the desired angle of the bend. The predetermined diameter will typically equal the thickness of the wood in the sheet the diameter but may be larger or smaller. FIGS. 1A and 1B show the shape of the cutout for a 90 degree bend, FIGS. 2A and 2B show the shape for a 45 degree bend, FIGS. 3A and 3B show the shape for a 135 degree bend, and FIGS. 4A and 4B show the shape for a 180 degree bend.

Prior to bending of the sheet the laminate covering the cutout is heated until it is bendable, if heating is necessary to bend it, and adhesive is applied to a circular cylindrical dowel 107 having the predetermined diameter. The dowel is then placed in the cutout and the sheet is bent around the dowel until the sheet completely touches the dowel, which will bend the sheet to the proper angle. Because the dowel fills the cutout, the entire joint is structurally bonded. The dowel can be any compatible material, such as wood, plastic, metal, cardboard or a composite.

An apparatus for bending such a sheet without stretching the laminate on the outer surface of the bend during bending is shown in FIGS. 5 through 10. The apparatus contains a first platform 101 upon which the portion 102 of the sheet 100 on one side of the cutout is held during bending, a second platform 103, upon which the portion 104 of the sheet on the other side of the cutout is held during bending, clamps 105 for securing both portions of the sheet 100 to the respective platforms, a spindle 106 that maintains the dowel 107 in the axis of bend during bending, a rotation mechanism 132 that rotates the second platform 103 relative to the first platform 101 around the axis of bending and causes the panel to be bent, tracks 108 that allow the second platform to move towards the cutout during the bending process and a regulation mechanism 134 which regulates the amount of such movement so that the laminate is not stretched or compressed during bending.

The entire apparatus is placed on a stand (not shown) which supports the first platform horizontally slightly below the waist of the operator. When the sheet 100 is placed on the apparatus, FIGS. 5, 6 and 7, the second platform 103 is also horizontal and is co-planer with the first platform. The sheet is positioned with the cutout 117 at the inside edge of the second platform, FIG. 6, and the clamps 105 are activated to clamp the sheet portions 102, 104 to the respective platforms. The clamps 105 can be vacuum or mechanical and are a type which are well known in the clamping arts.

Located on the second platform directly under the cutout 117 is a heater unit 125 which is used to heat the laminate 128 to its bending temperature, if necessary. A transparent window 126 is located at the surface of the second platform above the heater unit. In the embodiment illustrated the heater is an electric radiant heating element 109 and it is located in a reflector 119 which focuses the heat generated by the heater on the laminate, FIG. 7. The reflector has a rotation mechanism (not shown) which allows the reflector to be rotated, FIG. 8, to quickly discontinue heating the laminate. The heater unit shown is illustrative only and many other types of heater units could be provided. In addition, the heater unit could heat from above the sheet as well as from below. A thermostat (not shown) can be placed in the cutout to monitor the temperature of the laminate and shut the heater off when the proper laminate temperature is reached.

Located above the second platform is a spindle 106 which carries the dowel 107. A motor (not shown) can be provided to rotate the spindle and dowel if desired. The spindle is mounted on arms 130 which can move the dowel between a first position, FIG. 7, where the dowel is located above the sheet, and a second position, FIG. 8, where the dowel is located in the end of the cutout 117 closest to the first platform. The arms 130 also hold the dowel in the second position as the sheet is bent around it. A motor (not shown) can be provided to move the arms 130 between their first and second positions.

A dowel heater 112 may be provided to preheat the dowel 107 prior to applying the adhesive. The heater is mounted on an arm 113 which can be raised when the sheet is being bent, FIG. 5. A heater is necessary for some, but not all, types of adhesives.

An adhesive gun 110 is used to apply adhesive to the dowel when the spindle is in its first position. The adhesive gun is on a track 111 which allows it to be moved across the dowel as adhesive is applied. A motor (not shown) moves the adhesive gun across the track. In the embodiment illustrated, the dowel is rotated as the adhesive is applied, giving a spiral adhesive pattern. Whether this is done depends on the type of adhesive being used. The track 111 also can be raised when the sheet is being bent, FIG. 5.

A rotation mechanism 132 powered by a motor 133 rotates the second platform relative to the first platform to bend the sheet. The rotation mechanism is connected to the second platform through tracks 108, FIG. 10, which allowed the second platform to slide in and out relative to the first platform. A regulation mechanism 134 selectively moves the second platform along the tracks 108 as the second platform is rotated to ensure that the laminate is not stretched or compressed during bending. In the embodiment illustrated, this is accomplished by placing a rack 114 on the second platform. A pinion 115, which is rotatively mounted on the frame and does not move with the second platform, engages the rack. The rotational axis of the pinion is coaxial with the axis of the dowel when the dowel is in its second position. In addition, the pinion has a pitch diameter which is equal to the diameter of the dowel. Other types of regulation mechanisms, such as computer-controlled piston cylinders, could be used as well.

The entire operational sequence of the apparatus could be controlled by a microprocessor. After a sheet 100 is placed in the proper location, the clamps 105 are actuated, and a dowel 107 is placed on the spindle 106 the microprocessor would be started. The heater 109 would then start to heat the laminate 128. At the same time the arm 113 would be rotated to place the dowel heater 112 alongside of the dowel and the dowel heater would be turned on. The adhesive gun track 111 would be lowered. When the thermostat senses that the laminate has reached the proper temperature, the heater 109 would be shut off and the reflector 119 rotated. The dowel would then be rotated and the adhesive gun 112 would be turned on and translated across the track 111, to apply adhesive to the dowel. When the adhesive had been applied, the arm 113 and track 111 would be raised to raise the dowel heater and the adhesive gun, and the arms 120 would be activated to move the dowel to its second position in the cutout. The rotation mechanism 132 would then rotate the second platform to the desired angle. The second platform would be held in this position until the adhesive had cured and the laminate had cooled down. The clamps would then be released and the second sheet could be removed.

What is claimed is:

1. A method for bending a sheet of wood having an outside face and an inside face, said outside face having a plastic laminate applied thereto, to form a rounded corner in said sheet, said method comprising:

(a) making a cut across said sheet at the line of the bend, said cut opening out of the inside face of said sheet and forming a gap in said inside face;

(b) said cut having a cross-sectional shape such that an elongate, circular, cylindrical opening having a predetermined diameter will be formed in said sheet and said gap will be substantially closed when said sheet is bent to its desired angle;

(c) placing adhesive on a circular cylindrical dowel having said predetermined diameter and placing said dowel in said cut; and (d) bending said sheet around said dowel until said sheet is completely in contact therewith.

2. The method of claim 1, including the further step of heating said plastic laminate adjacent said cut to make it bendable before placing said dowel in said cut.

3. The method of claim 1, including the further step of holding said sheet in its bent condition until said laminate has cooled and the adhesive has set.

4. The method of claim 1 wherein said cut extends to said laminate.

5. The method of claim 1 wherein said sheet is bent to a 90 degree angle.

6. The method of claim 1 wherein said sheet is bent to an obtuse angle.

7. The method of claim 1 wherein said sheet is bent to an acute angle.

8. The method of claim 1 wherein said sheet is bent to a 180 degree angle.

9. An apparatus for bending the sheet of claim 1 comprising:

(a) a first platform which fixedly engages the outside face of said sheet on one side of said cut;

(b) a second platform which fixedly engages the outside face of said sheet on the other side of said cut; and (c) a mechanism for rotating said second platform relative to said first platform while simultaneously translating said second platform toward said cut such that said laminate is not stretched while said sheet is being bent.

10. The apparatus of claim 9 wherein said mechanism for rotating comprises:

(a) tracks which slidably carry said second platform;

(b) a device which rotates said tracks relative to said first platform; and (c) a regulation mechanism which selectively moves said second platform along said tracks as said track are rotated.

11. The apparatus of claim 9 wherein said regulation mechanism comprises a rack which is fixably attached to said second platform and is movable therewith and a pinion which engages said rack and is not movable with said second platform.

12. The apparatus of claim 11 wherein said pinion has a rotational axis which is coextensive with the center line of said dowel when the sheet is bent around said dowel.

13. The apparatus of claim 9 wherein said second platform extends under the cut in said sheet.

14. The apparatus of claim 13, including a heater for heating the laminate on said sheet prior to said sheet being bent.

15. The apparatus of claim 14 wherein said heater is located in said second platform below said cut.

16. The apparatus of claim 15 wherein said heater is a radiant heater and a reflector focuses the heat generated by said heater on the said laminate.

17. The apparatus of claim 16 wherein said reflector is rotatable to discontinue focusing heat from said heater onto said laminate.

18. The apparatus of claim 9, including:

(a) a spindle which supports said dowel;

(b) a linkage which allows said spindle to be moved between a first position where said dowel is supported away from said cut and a second position where said dowel is located in said cut.

19. The apparatus of claim 18, including an adhesive gun which applies adhesive to said dowel when said spindle is in its first position.

20. The apparatus of claim 19, including a dowel heater which preheats said dowel prior to and during the application of glue thereto.

* * * * *